United States Patent [19]

Senoo et al.

[11] 4,448,144

[45] May 15, 1984

[54] METHOD FOR OPENING, CLOSING AND ROTATING RIGID MARINE SAIL

[75] Inventors: Akira Senoo, Yokosuka; Yuzo Nezu, Zama; Masanori Ito, Tokyo; Hironobu Nagano; Tatsuo Aire, both of Yokohama, all of Japan

[73] Assignees: Japan Marine Machinery Development Association, Tokyo; Aitoku Company Limited, Yamaguchi; Nippon Kokan Kabushiki Kaisha, Tokyo, all of Japan

[21] Appl. No.: 281,164

[22] Filed: Jul. 7, 1981

[30] Foreign Application Priority Data

Jul. 21, 1980 [JP] Japan ..... 55-98687

[51] Int. Cl.[3] ..... B63B 49/00; B63H 9/06; G05B 7/02

[52] U.S. Cl. ..... 114/102; 364/424; 364/734

[58] Field of Search ..... 364/424, 734; 114/102, 114/103; 73/178 R, 188

[56] References Cited

U.S. PATENT DOCUMENTS

| | | | |
|---|---|---|---|
| 3,934,129 | 1/1976 | Taylor et al. | 364/424 |
| 3,934,533 | 1/1976 | Wainwright | 114/103 |
| 3,935,828 | 2/1976 | Pfund | 114/102 |
| 3,936,663 | 2/1976 | Taylor et al. | 364/734 |
| 4,236,409 | 12/1980 | Brachet | 114/102 X |

FOREIGN PATENT DOCUMENTS

| | | | |
|---|---|---|---|
| 1089656 | 9/1960 | Fed. Rep. of Germany . | |
| 2167324 | 8/1973 | France . | |
| 55-47994 | 4/1980 | Japan | 114/102 |
| 1121620 | 7/1968 | United Kingdom . | |

OTHER PUBLICATIONS

The Radio and Electronic Engineer, vol. 43, nr. 12, Dec. 1973, London, GB J. Elliot: "The Computation of the Best Windward and Running Courses for Sailing Yachts" pp. 715–720.

*Primary Examiner*—Felix D. Gruber

*Attorney, Agent, or Firm*—Frishauf, Holtz, Goodman & Woodward

[57] ABSTRACT

A method for opening, closing and rotating a rigid marine sail, which comprises the steps of: selectively opening, closing and rotating, in response to a wind velocity and a wind direction, a rigid sail comprising at least two sail portions which are fitted in front of a mast rotatable around the vertical axis thereof substantially in parallel with said axis, and which are selectively pivotably movable between the opened position and the closed position relative to the mast: the method being characterized by: smoothing a plurality of wind velocity signals and a plurality of wind direction signals from a wind velocity/wind direction meter, by a calculating device at prescribed intervals of time; determining opening and closing of the at least two sail portions by the calculating device on the basis of smoothed wind velocity signals and smoothed wind direction signals; automatically selectively opening or closing the at least two sail portions by an opening/closing device in response to the determination; determining by the calculating device an optimum sail angle relative to the horizontal reference line of the ship, the optimum sail angle providing the maximum propulsion to the at least two sail portions when the said portions are opened, and minimizing the wind resistance acting on the at least two sail portions when the sail portions are closed; and, selectively rotating the mast together with the at least two sail portions, by a mast rotating mechanism, in response to the deviation of an actual sail angle relative to the horizontal reference line of the ship from the optimum sail angle, thereby always keeping the at least two sail portions at the optimum sail angle.

2 Claims, 13 Drawing Figures

| | |
|---|---|
| FIG. 11A | |
| FIG. 11B | |
| FIG. 11C | |

METHOD FOR OPENING, CLOSING AND ROTATING RIGID MARINE SAIL

FIELD OF THE INVENTION

The present invention relates to a method which permits easy and certain rotation, opening and closing of a rigid sail of a ship in response to changes in wind velocity and wind direction, with a view to effectively utilizing the wind force for propulsion of the ship.

BACKGROUND OF THE INVENTION

For the effective use of the wind force for the propulsion of a ship from the point of view of energy saving, fitting of sails to ships is being proposed. One of the conventional sails to be fitted to the ship is a canvas sail. A sail of this kind however requires much time and labor for handling.

To solve this difficulty, a sail comprising thin metal sheets or synthetic resin sheets fitted to reinforcing ribbed members (hereinafter simply referred to as a "rigid sail") has been used in place of the above-mentioned canvas sail. This rigid sail, capable of being automatically opened and closed by a mechanical force, can solve the above-mentioned problem.

As one of such rigid sails, a rigid sail substantially identical with the rigid sails shown in FIGS. 1 to 4 is disclosed in Japanese Patent Provisional Publication No. 47,994/80 (hereinafter referred to as the "prior art"). This rigid sail is described below. In FIGS. 1 to 4, 1 is a mast equipped vertically on the deck (not shown) of a ship. 2 is a mast rotating mechanism for rotating the mast 1 around the axis thereof. This mechanism 2 comprises a gear 3 fixed on the periphery of the mast 1 in the lower portion thereof and a motor 5 having another gear 4 engaging with the above-mentioned gear 3. 6 is a rigid sail fitted to the mast 1 in parallel with the axis thereof through a plurality of fitting members 7, the rigid sail 6 comprising a central sail portion 6A fixed to the mast 1, and two sail portions 6B fitted to both ends of the central sail portion 6A so as to be pivotably movable. 8 is an opening/closing device for opening and closing each of the sail portions 6B, this device 8 comprising a movable rod 10 vertically movably fitted, through a plurality of guide members 9, to the mast 1 in parallel therewith, a lift 11 comprising, for example, a cylinder for vertically moving the movable rod 10, and a plurality of connecting rods 12 provided at prescribed intervals in a vertical row on each of the sail portions 6B, one-side ends of the connecting rods 12 being connected, through respective universal bearings 13, to each of the sail portions 6B at prescribed intervals to form a vertical row, and the other ends of the connecting rods 12 being connected, through another respective universal bearings 14, to the movable rod 10 at prescribed intervals to form a vertical row.

By driving the motor 5 of the mast rotating mechanism 2, the rigid sail 6 is rotated around the mast 1 through the gears 3 and 4. The sail portions 6B of the rigid sail 6 are opened, as shown in FIGS. 1 and 2, by raising the movable rods 10 with the lift 11, and are closed, as shown in FIGS. 3 and 4, by lowering the movable rods 10 with the lift 11.

The above-mentioned rigid sail should be easily and certainly rotated, opened and closed in response to changes in wind velocity and wind direction, but such a method has not as yet been proposed.

SUMMARY OF THE INVENTION

A principal object of the invention is therefore to provide a method which permits easy and certain rotation, opening and closing of a rigid sail equipped on a ship in response to changes in wind velocity and wind direction, with a view to effectively utilizing the wind force for the propulsion of the ship.

In accordance with one of the features of the present invention, there is provided a method for opening, closing and rotating a rigid marine sail, which comprises the steps of: selectively opening, closing and rotating, in response to a wind velocity and a wind direction, a rigid sail comprising at least two sail portions which are fitted in front of a mast rotatable around the vertical axis thereof substantially in parallel with said axis, and which are pivotably movable between the opened position and the closed position relative to said mast; said method being characterized by: smoothing a plurality of wind velocity signals and a plurality of wind direction signals from a wind velocity/wind direction meter, by a calculating device at prescribed intervals of time; determining opening and closing of said at least two sail portions by said calculating device on the basis of said smoothed wind velocity signals and said smoothed wind direction signals; selectively automatically opening or closing said at least two sail portions by an opening/closing device in response to said determination; determining by said calculating device an optimum sail angle relative to the horizontal reference line of the ship, said optimum sail angle providing the maximum propulsion to said at least two sail portions when said sail portions are opened, and minimizing the wind resistance acting on said at least two sail portions when said sail portions are closed; and selectively rotating said mast together with said at least two sail portions, by a mast rotating mechanism, in response to the deviation of an actual sail angle relative to said horizontal reference line of the ship from said optimum sail angle, thereby always keeping said at least two sail portions at the optimum sail angle.

DETAILED DESCRIPTION OF THE PREFERRED EMBODIMENTS

Figure 1:
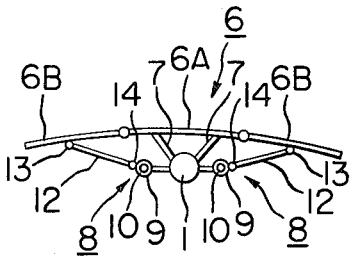
FIG. 1 is a plan view illustrating an opened state of the rigid sail of the prior art.
Figure 2:
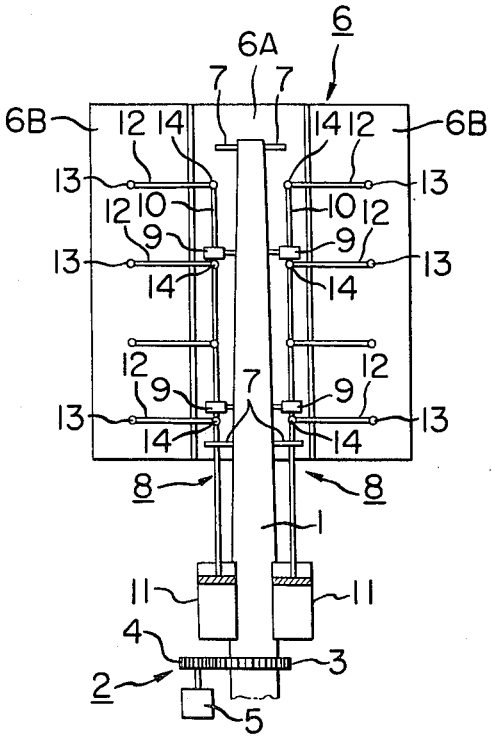
FIG. 2 is a partially cutaway front view illustrating an opened state of the rigid sail of the prior art.
Figure 3:
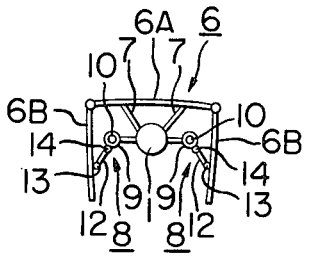
FIG. 3 is a plan view illustrating a closed state of the rigid sail of the prior art.
Figure 4:
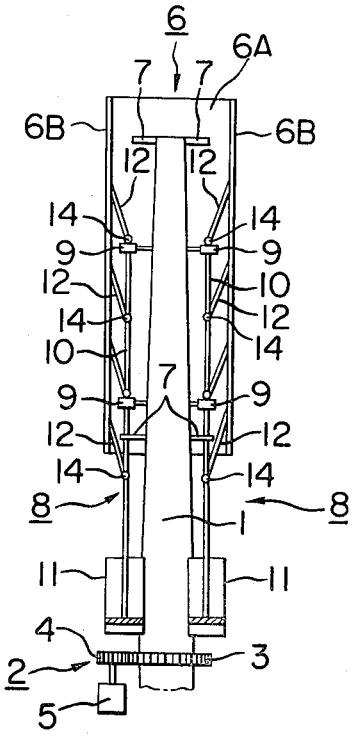
FIG. 4 is a partially cutaway front view illustrating a closed state of the rigid sail of the prior art.
Figure 5:
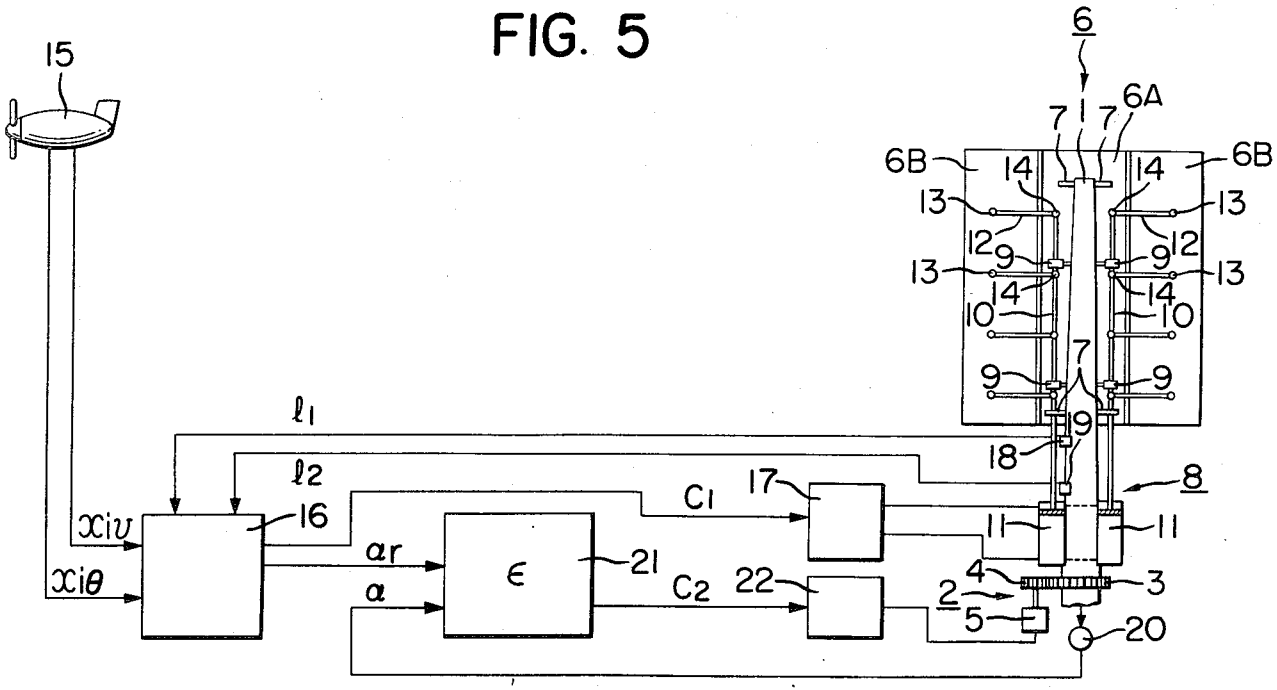
FIG. 5 is a schematic descriptive view illustrating an embodiment of the method of the present invention.

Now, the application of the method of the present invention to the rigid sail shown in FIGS. 1 to 4 is described below with reference to FIGS. 5, 11A, 11B and 11C. In FIG. 5, 15 is a wind velocity/wind direction meter attached to the ship (not shown). 16 is a calculating device which functions to smooth, at prescribed intervals, a plurality of wind velocity signals, and a plurality of wind direction signals from the wind velocity/wind direction meter 15 to determine whether or not smoothed wind velocity signals and wind direction signals satisfy conditions suitable for opening the two sail portions 6B, and send a sail portion opening/-closing instruction signal $C_1$ to a lift controller described later in response to the results of the above determination. At the same time, the calculating device 16 has the function to calculate the optimum sail angle $\alpha_r$ in response to the smoothed wind direction signals, which angle ($\alpha_r$) of the rigid sail 6 relative to a horizontal reference line of the ship provides the maximum propulsion to the rigid sail 6 when the sail portions 6B are opened and can minimize the wind resistance acting on the rigid sail 6 when the sail portions 6B are closed. The calculating device 16 has the function to send the calculated resins to a mast rotating mechanism described later. 17 is a lift controller which is actuated by a sail portion opening/closing instruction signal $C_1$ sent from the calculating device 16, and has the function to drive the lifts 11 simultaneously. 18 and 19 are limit switches attached to the mast 1. The limit switch has the function to send a sail portion opening completion signal $l_1$ to the calculating device 16 when the sail portions 6B are completely opened. The other limit switch 19 has the function to send a sail portion closing completion signal $l_2$ to the calculating device 16 when the sail portions 6B are completely closed. 20 is an angle detector which is attached to the mast 1 for detecting the rotation angle of the mast 1. 21 is the mast rotation controller which functions to determine the deviation $\epsilon$ of the actual sail angle $\alpha$, which angle $\alpha$ is detected by the angle detector 20 relative to the horizontal reference line of the ship, from the above-mentioned optimum sail angle $\alpha_r$ and send the mast rotation instruction signal $C_2$ to the mast rotating mechanism controller described later until the deviation $\epsilon$ becomes zero. 22 is a mast rotating mechanism controller which is actuated by the mast rotation instruction signal $C_2$ and drives the mast rotating mechanism 2.

A plurality of wind velocity signals and a plurality of wind direction signals from the wind velocity/wind direction meter 15 are smoothed by the calculating device 16 at prescribed time intervals. The reason for the smoothing is as follows: Since both the wind velocity signals and the wind direction signals contain variable components of a considerably high frequency, it is not proper to use these wind velocity signals and wind direction signals both containing such high-frequency variable components for rotating, opening and closing operations of the rigid sail. Smoothing is possible using either of the following two methods:

Smoothing method 1

Measuring wind velocity signals or wind direction signals from the wind velocity/wind direction meter at prescribed time intervals, and calculating a plurality of wind velocity signals or wind direction signals in accordance with the following equation (1):

$$\overline{X}_n=(\chi_1+\chi_2+\ldots+\chi_{n-1}+\chi_n)/n \quad (1)$$

where, $\overline{X}_n$: Smoothed wind velocity signals or wind directions signals;

$\chi_n$: n-th wind velocity signal or wind direction signal;

n: the number of wind velocity signals or wind direction signals.

Smoothing method 2

Measuring wind velocity signals or wind direction signals from the wind velocity/wind direction meter at prescribed time intervals, and calculating a plurality of wind velocity signals or wind direction signals in accordance with the following equation (2):

$$\overline{X}_n = \overline{X}_{n-1} + (\chi_n - \overline{X}_{n-1}) \exp\left(-\frac{\Delta t}{T}\right) \quad (2)$$

where, $\overline{X}_n$: smoothed wind velocity signal or wind direction signal, $\overline{X}_{n-1}$: smoothed wind velocity signal or wind direction signal directly before $\overline{X}_n$, $\chi_n$: n-th wind velocity signal or wind direction signal, T: time constant under the first order lag, and $\Delta t$: time interval for measuring the wind velocity or wind direction.

Figure 6:
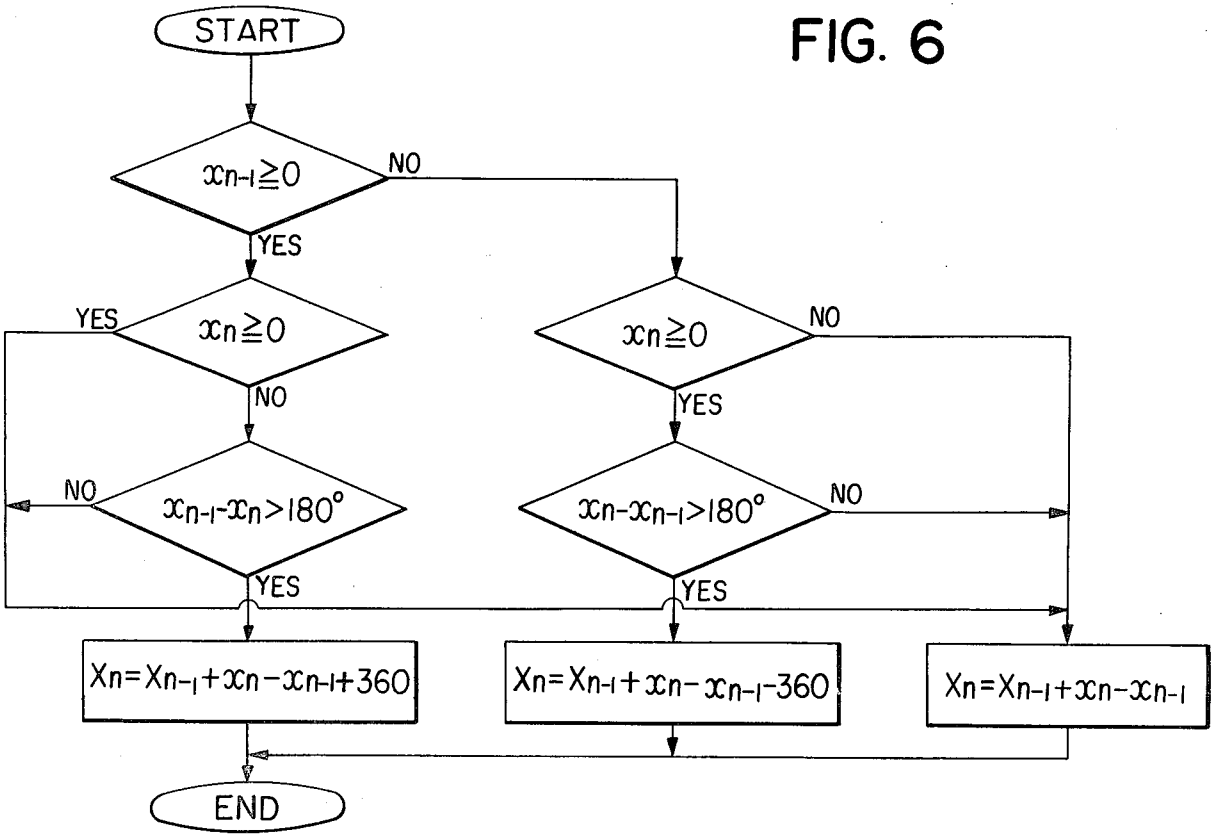
FIG. 6 is a flow chart illustrating the smoothing method of wind direction signals of the method of the present invention.
Figure 7:
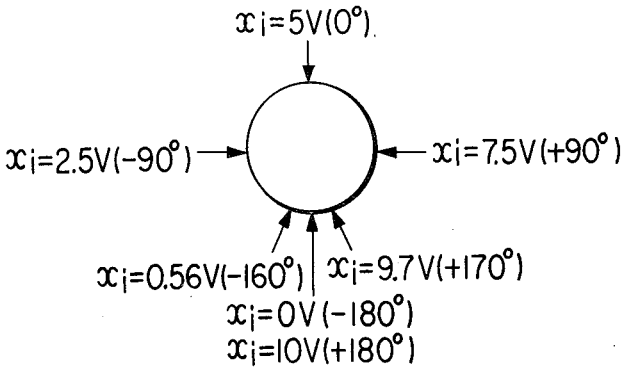
FIG. 7 is a descriptive drawing of the wind direction.

When smoothing wind velocity signals, calculation can be performed by the above-mentioned equations (1) and (2) without difficulty, since the value of wind velocity signal continuously varies. When smoothing wind direction signals, however, if the wind direction changes continuously in one direction, i.e., if it changes by more than 360° clockwise or anticlockwise, the wind direction signals always contain a point of discontinuity. This is due to the fact that a wind direction signal $\chi_i$ is put out from the wind direction meter in the form of, for example, a voltage as shown in FIG. 7. More particularly, when the wind direction changes from just behind the ship clockwise by 360°, the wind direction signal $\chi_i$ varies from 0 V to 10 V. Therefore, a point of discontinuity occurs between 0 V and 10 V. To solve this problem, the above-mentioned wind direction signal $\chi_n$ is converted into a value $X_n$ to which the equations (1) and (2) presented above are applied. The flow chart for the calculation of the value $X_n$ is shown in FIG. 6. When the wind direction signal changes, for example, from 0.56 V (−160°) anticlockwise to 9.7 V (+170°), it is converted into the following continuity of values:

Wind direction signal before conversion:

$$\chi_{n-1}=0.56\text{ V }(-160°)\rightarrow\chi_n=9.7\text{ V }(+170°)$$

Wind direction signal after conversion:

$$X_{n-1}\rightarrow X_n=X_{n-1}-(0.56+10-9.7)\text{ V }(-30°)$$

As shown in FIG. 7, the range of possible values of the wind direction signal $\chi_i$ is from 0 V (−180°) to 10 V (+180°), whereas the wind direction signal $X_n$ after conversion may take a value beyond the above-mentioned range. When the final wind direction signal $\overline{\chi}_n$ obtained after smoothing takes a value corresponding to −200°, this value is converted into another value corresponding to +160°.

The degree of the above-mentioned smoothing can be freely changed by selecting the number n of wind velocity signals or wind direction signals in the above-mentioned equation (1), and by selecting the time constant T in the above-mentioned equation (2).

Then, the calculating device 16 determines, on the basis of the smoothed wind velocity signals and wind direction signals thus obtained, whether or not the wind force can be safely and effectively utilized as the propulsion for the ship. The following three conditions are set for the above determination:

(1) $v \leqq v_u$
where
- $v$: apparent wind velocity measured on the ship (relative wind velocity); and
- $v_u$: upper limit value of the "$v$" determined by the total area of the rigid sail and the stability of the ship;

(2) $v_a \leqq v_{au}$
where,
- $v_a$: actual wind velocity on the sea (true wind velocity); and
- $v_{au}$: upper limit value of "$v_a$" determined by the total area of the rigid sail and the stability of the ship; and (3) $\theta \geqq \theta_l$
where,
- $\theta$: apparent wind direction measured on the ship (relative wind direction); and
- $\theta_l$: the lower limit value of the "$\theta$", in which the rigid sail no longer produces an effective propulsion.

Figure 8:
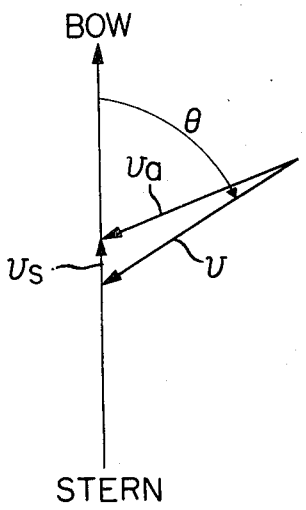
FIG. 8 is a descriptive drawing of the true wind velocity $v_a$, the relative wind velocity $v$, and the relative wind direction $\theta$, in the case where the ship is running at a speed of $v_s$.

FIG. 8 shows the relationship between the ship speed $v_s$, the relative wind velocity $v$, the true wind velocity $v_a$ and the relative wind direction $\theta$.

The relationship between the above-mentioned $v_s$, $v$, $v_a$ and $\theta$ is expressed by the following equation (3):

$$v_a^2 = v_s^2 + v^2 - 2v_s v \cos\theta \quad (3)$$

As for the above-mentioned conditions (1) and (3), determination can be easily made by comparing wind velocity signals with the prescribed upper limit value $v_u$ and comparing wind direction signals with the prescribed lower limit value $\theta_l$. With regard to the condition (2), in which the true wind velocity that cannot be directly measured on a ship is involved, determination is made with the use of the above-mentioned equation (3). More specifically, determination is done using the following equation (4) solving the equation (3) as to the relative wind velocity $v$ by introducing the upper limit value $v_{au}$ as the true wind velocity $v_a$:

$$v \leqq v_s \cos\theta + \sqrt{-v_s^2 \sin^2\theta + v_{au}^2} \quad (4)$$

Figure 9:
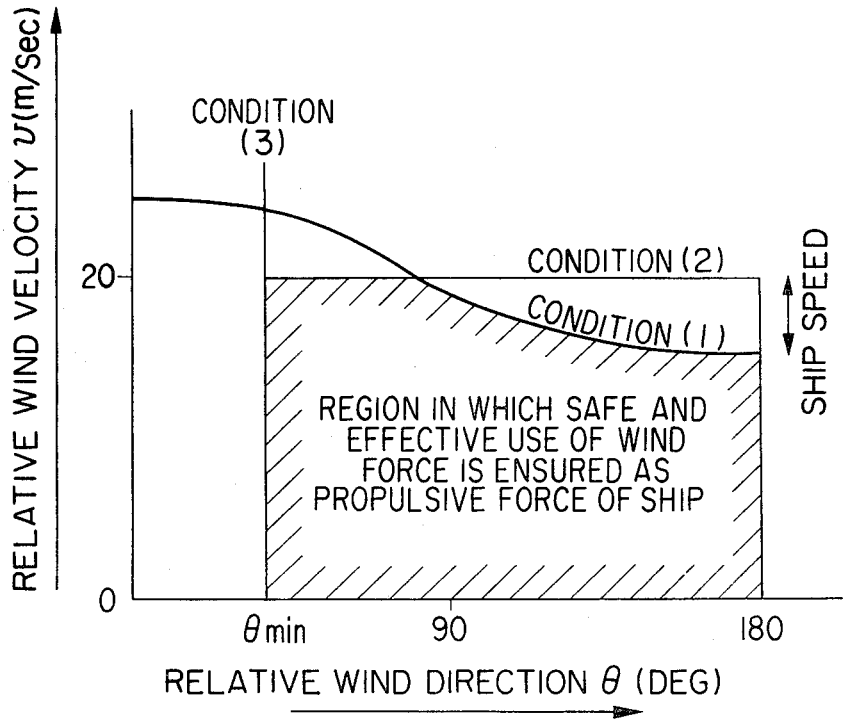
FIG. 9 is a descriptive drawing illustrating conditions allowing safe and effective utilization of the wind force as the propulsion of the ship.

In the equation (4), when the ship speed $v_s$ can be considered to be constant, it would be possible to make determination on the above-mentioned condition (2) with the use of two data, i.e., the relative wind direction $\theta$ and the relative wind velocity $v$. The value obtained by substituting the relative wind direction $\theta$ into the right side of the equation (4) and the actually measured relative wind velocity $v$ are compared. If the former value is larger than the latter one, the above-mentioned condition (2) is satisfied. FIG. 9 shows an example of the range within which the wind force dependent on the above-mentioned three conditions can be safely and effectively utilized as the propulsion for the ship.

A sail portion opening/closing instruction signal $C_1$ is sent from the calculating device 16 to the lift controller 17, in response to the result of the above-mentioned determination. Namely, when the wind force is determined to be capable of being safely and effectively utilized as the propulsion for the ship, the calculating device 16 issues an opening instruction signal of the sail portions 6B to the lift controller 17. This causes actuation of the lifts 11 to raise the movable rods 10, thus opening the sail portions 6B. When the wind force is determined not to be capable of being safely and effectively utilized as the propulsion for the ship, on the other hand, the calculating device 16 issues a closing instruction signal of the sail portions 6B to the lift controller 17. This causes actuation of the lifts 11 to lower the movable rods 10, thus closing the sail portions 6B. When opening or closing of the sail portions 6B is completed, the limit switch 18 or 19 is actuated and a said portion opening completion signal $l_1$ or a said portion closing completion signal $l_2$ is transmitted to the calculating device 16 for confirmation of opening or closing of the sail portions 6B.

Figure 10:
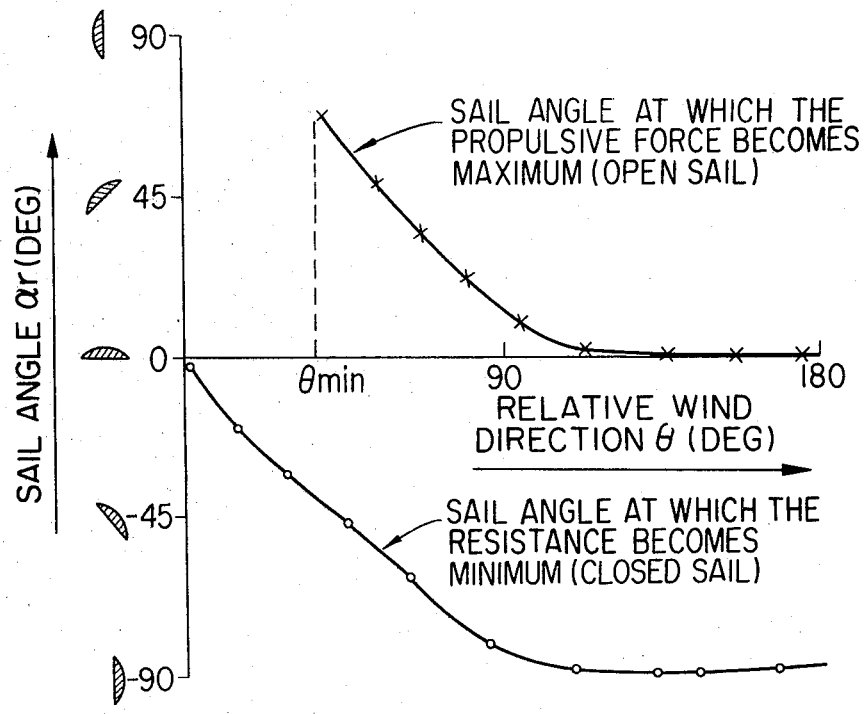
FIG. 10 is a graph showing the relationship between the relative wind direction and the set value of sail angle; and, FIGS. 11A, 11B and 11C are respective parts of a flow chart of an embodiment of the method of the present invention.
Figure 11A:
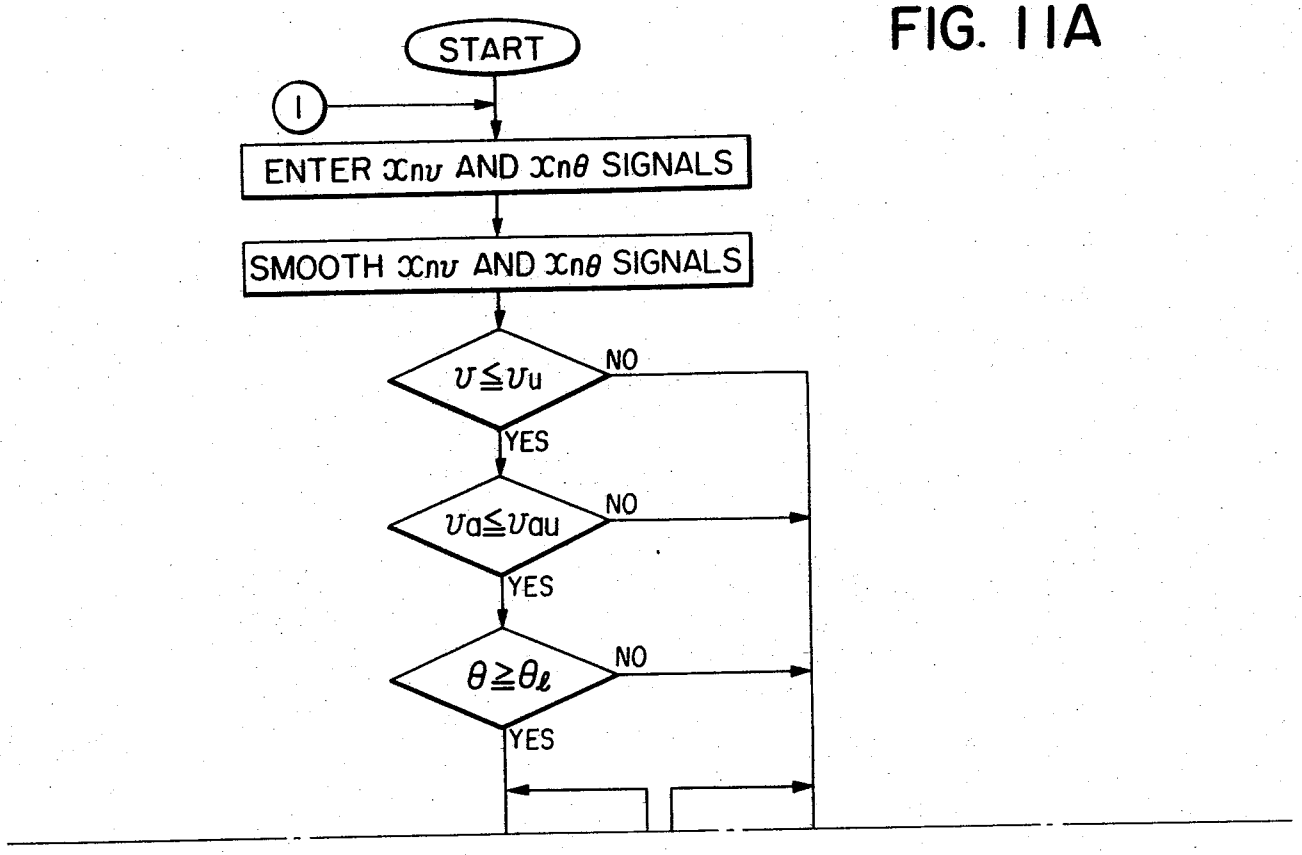
Figure 11B:
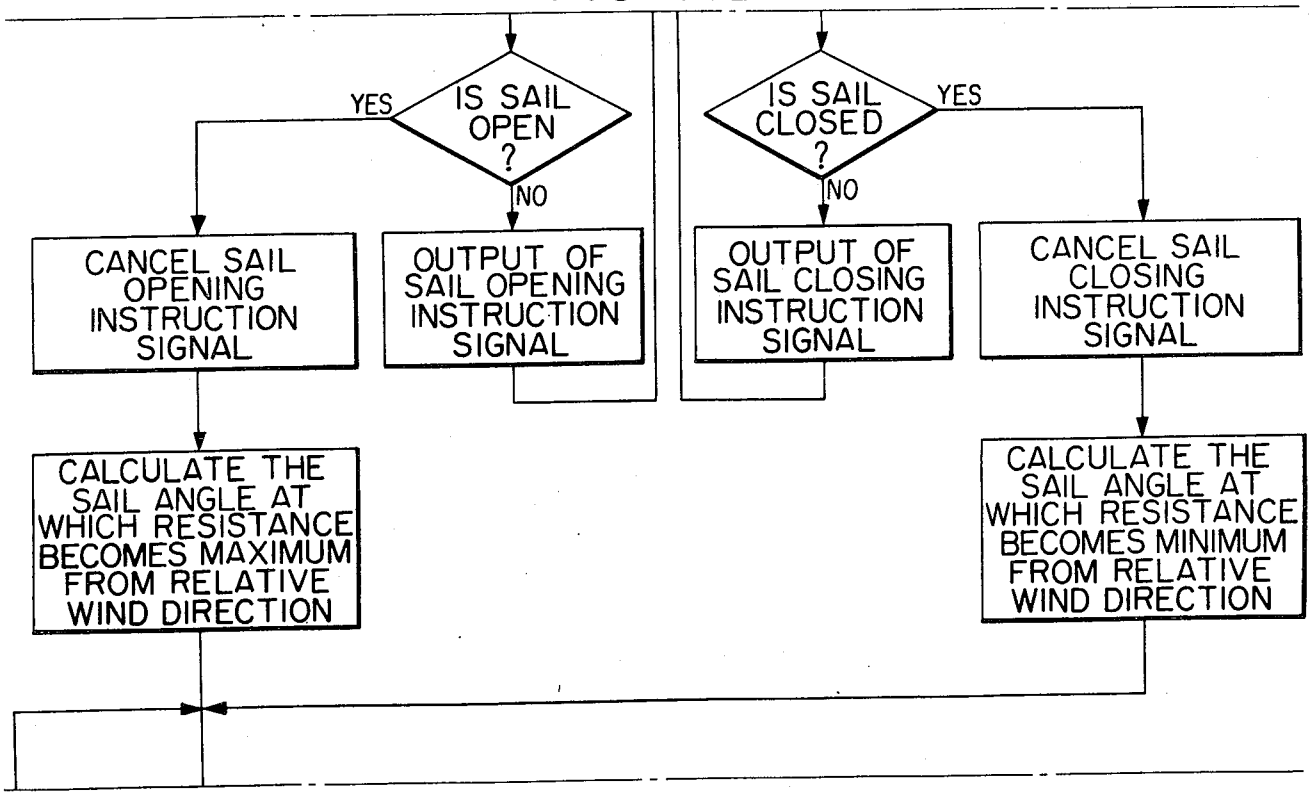
Figures 11, 11C:
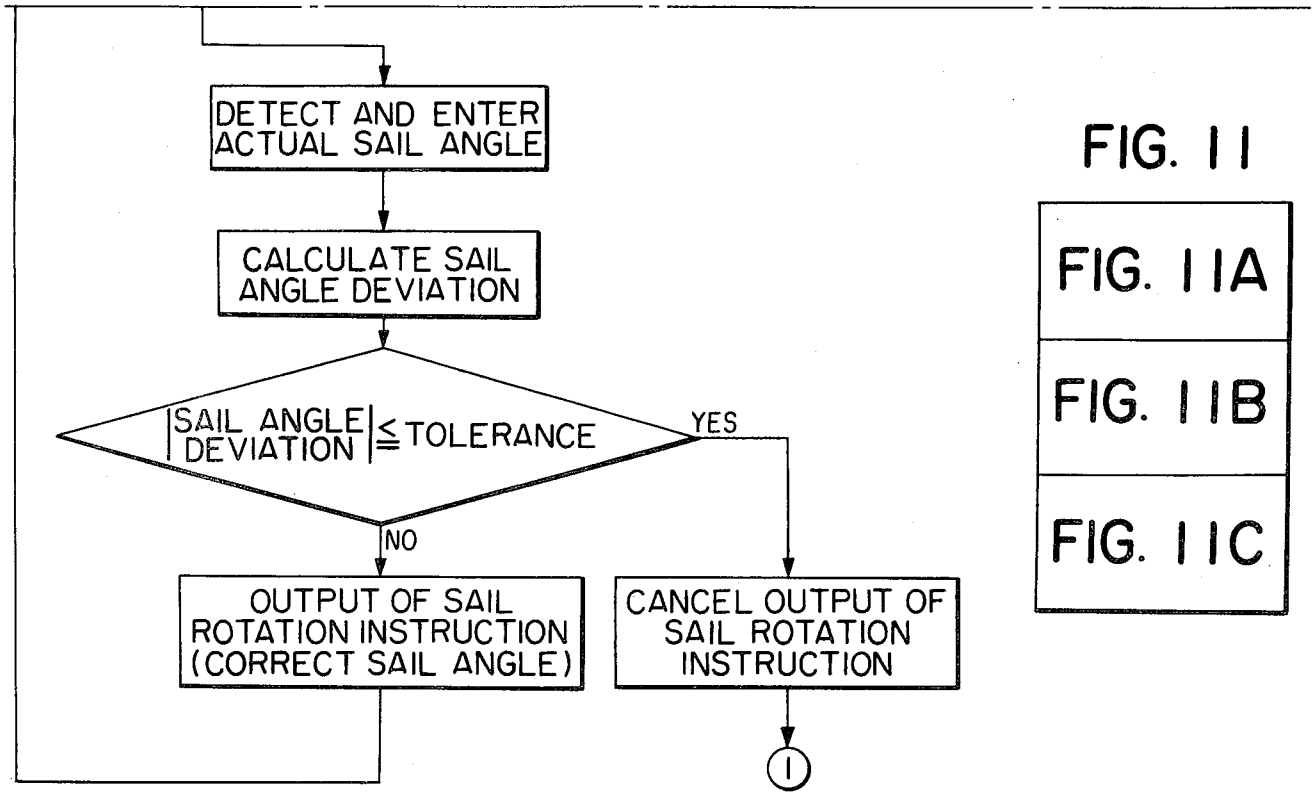

Then, the optimum sail angle is calculated by the calculating device 16 on the basis of the smoothed wind direction signals. This is done as follows. As shown in FIG. 10, the relationship between the relative wind direction and the said angle giving the maximum propulsion in the opened position of the sail portions 6B, and the relationship between the relative wind direction and the said angle giving the minimum wind resistance to the rigid sail in the closed position of the said portions 6B are previously calculated and stored in the calculating device 16. In response to the relative wind direction signals from the wind velocity/wind direction meter 15, the device 16 calculates the sail angle giving the maximum propulsion when the sail portions 6B are opened, and on the other hand the sail angle giving the minimum wind resistance to the rigid sail 6 when the sail portions 6B are closed, these angles being set as the optimum sail angle $\alpha_r$.

Then, the deviation $\epsilon$ of the actual sail angle $\alpha$, which angle $\alpha$ is detected by the angle detector 20 relative to the horizontal reference line of the ship, from the set value of the optimum said angle $\alpha_r$ is calculated by the mast rotation controller 21, and a mast rotation instruction signal $C_2$ is sent to the mast rotating mechanism controller 22 until the above deviation $\epsilon$ becomes zero. The mast rotating mechanism 2 is driven by the mast rotating mechanism controller 22, and the rigid sail 6 is rotated, together with the mast, to form the optimum said angle.

According to the present invention, as described above, it is possible to selectively easily and certainly rotate, open and close a rigid sail of a ship in response to changes in the wind velocity and the wind direction, with a view to effectively utilizing the wind force as propulsion for the ship, thus providing industrially useful effects.

What is claimed is:

1. A method of selectively opening or closing, and rotating a generally rigid marine sail, the sail comprising at least first and second sail portions selectively pivotably movable between an open position and a closed position about a substantially vertical axis associated with a mast of a ship, and said mast being rotatable about its own axis;

the method comprising:

smoothing a plurality of signals representative of the wind velocity at predetermined time intervals;

smoothing a plurality of signals representative of the wind direction at predetermined time intervals;

determining on the basis of said smoothed wind velocity signal and said smoothed wind direction signal whether said sail portions are to be in the open or closed position;

automatically operating an apparatus for selectively opening or closing said sail portions in accordance with said aforementioned determinating step;

determining an optimum sail angle, relative to the ship, at which said sail portions provide maximum propulsive effect when in said open position and minimum wind resistance when in said closed position; and rotating said mast together with said sail portions in accordance with any deviation between the actual sail angle and said determined optimum sail angle to thereby tend always to maintain said sail portions at said optimum sail angle;

either or both of said plurality of wind velocity signals and said plurality of wind direction signals being smoothed in accordance with the following equation:

$$\bar{\chi}_n = \bar{\chi}_{n-1} + (\chi_n - \bar{\chi}_{n-1}) \exp\left(-\frac{\Delta t}{T}\right)$$

where $\bar{\chi}_n$: smoothed wind velocity signal or smoothed wind direction signal, $\bar{\chi}_{n-1}$: smoothed wind velocity signal or smoothed wind direction signal directly before $\bar{\chi}_n$, $\chi_n$: n-th wind velocity signal or wind direction signal, T: time constant under the first order lag; and $\Delta t$: time interval for measuring the wind velocity or wind direction.

2. The method as claimed in claim 1, wherein:

said at least two sail portions are opened when the following conditions (1) to (3) are satisfied:

(1) $v \leqq v_u$ where $v$: apparent wind velocity measured on the ship, and $v_u$: upper limit value of the "$v$" determined by the total area of the rigid sail and the stability of the ship;

(2) $v_a \leqq v_{au}$ where $v_a$: actual wind velocity on the sea, and $v_{au}$: upper limit value of "$v_a$" determined by the total area of the rigid sail and the stability of the ship; and (3) $\theta \geqq \theta_l$ where $\theta$: apparent wind direction measured on the ship, and $\theta_l$: the lower limit value of the "$\theta$", in which the rigid sail no longer produce an effective propulsion;

and said at least two sail portions are closed when any one of the following conditions (4) to (6) are satisfied:

(4) $v > v_u$ (5) $v_a > v_{au}$, and (6) $\theta < \theta_l$.

* * * * *